United States Patent [19]

Grasshoff

[11] 4,115,282

[45] Sep. 19, 1978

[54] BIODEGRADABLE GREASE COMPOSITION

[75] Inventor: Hans Dieter Grasshoff, Hamburg, Fed. Rep. of Germany

[73] Assignee: Deutsche Texaco Aktiengesellschaft, Hamburg, Fed. Rep. of Germany

[21] Appl. No.: 744,579

[22] Filed: Nov. 24, 1976

[30] Foreign Application Priority Data

Dec. 2, 1975 [DE] Fed. Rep. of Germany ..... 2554077

[51] Int. Cl.[2] ..... C10M 3/18; C10M 5/14; C10M 7/20; C10M 7/24

[52] U.S. Cl. ..... 252/18; 252/22; 252/34.7; 252/42; 252/49.5

[58] Field of Search ..... 252/22, 49.5, 18, 34.7, 252/42

[56] References Cited

U.S. PATENT DOCUMENTS

| | | | |
|---|---|---|---|
| 2,635,067 | 4/1953 | Steiner et al. | 252/18 |
| 3,341,454 | 9/1967 | Chor et al. | 252/49.5 |
| 3,350,307 | 10/1967 | Brown et al. | 252/49.5 |
| 3,448,787 | 6/1969 | Beers | 252/49.5 |
| 3,574,110 | 4/1971 | Hampson et al. | 252/49.5 |
| 3,801,504 | 4/1974 | Stone | 252/49.5 |
| 3,843,529 | 10/1974 | Bertrand | 252/49.5 |
| 3,983,042 | 9/1976 | Jain et al. | 252/49.5 |
| 4,001,125 | 1/1977 | Newton | 252/49.5 |

*Primary Examiner*—Irving Vaughn

*Attorney, Agent, or Firm*—Thomas H. Whaley; Carl G. Ries; James J. O'Loughlin

[57] ABSTRACT

A biodegradable lubricating grease composition is provided comprising an emulsion of vegetable-derived gel, water and a lubricant from the class of natural oils and fats.

14 Claims, No Drawings

BIODEGRADABLE GREASE COMPOSITION

BACKGROUND OF THE INVENTION

Field of the Invention

Railway tracks for trains, trams, small gauge trains or large capacity dredger excavators are subject to wear and tear on curves or points and crossings as a result of lateral forces. Wear also occurs on the wheel flanges of the rail vehicles. In general, lubricants have been employed to protect rails, points and crossings and the wheel flanges of rail vehicles against this source of wear. The lubricant also serves to reduce the noise level emitted from these points.

A grease is normally employed to ameliorate the wear problems described above. The grease conventionally consists of a mineral lubricating oil as the main constituent as well as fatty acid soaps, especially calcium soaps, as thickening agents. Depending on requirements, such a grease composition will also contain small amounts of additional additives, such as anti-oxidants, anti-corrosion additives, extreme pressure additives and the like. In many cases, the conventional lubricating grease will also contain solid lubricants such as graphite or molybdenum disulphide. The composition and mode of action of known wheel flange lubricating greases is described in the Requirements Standard of the German Federal Railway, substance No. 077.02, January, 1974, and in "Standard Handbook of Lubrication Engineering," McGraw-Hill, 1968, chapter 43, pages 18–21.

A disadvantage of the known grease compositions for rails and rail vehicles is that they contain large amounts (in general 80–90%) of mineral lubricating oils. Mineral oils are not readily biodegradable. When using such a grease composition in the maintenance of railway tracks or trams, comparatively large amounts of the relatively non-degradable mineral oil component will pass into the sanitary sewage system as a result of rain or when the streets are cleaned by washing thus creating a serious contamination problem. Environmental harm also arises when the grease of optionally tracked rubbish excavators, or dredger excavators, cables, links and other similarly lubricated parts comes into direct contact with or contaminates the soil and/or surface waters.

SUMMARY OF THE INVENTION

The object of the invention is to provide a biodegradable grease for rails, rail points and crossings and rail vehicles consisting of a lubricating oil, water, a thickening agent and optionally additional additives. More specifically, the grease composition of the invention comprises a biodegradable vegetable or animal oil or fat in an aqueous mixture containing a vegetable-derived thickening agent or gel-forming agent.

It has been known that certain materials of vegetable origin, such as polysaccharides,alginates and cellulose derivatives, have a thickening and film-forming action as well as a specific emulsifying and dispersing power when dissolved in water. Since gels of the this type contain a large proportion of water, they have been considered unsuitable as a vehicle for preparing lubricant compositions.

It has now been discovered that emulsions can be produced from water and vegetable-derived thickening agents containing a natural oil or fat which forms an excellent lubricant and whose consistency can be adjusted to that of a grease. Since the vegetable-derived thickening agent or gel can be decomposed bacterially, completely biodegradable and relatively harmless lubricants are obtained if a natural fat or oil is emulsified with the said gel.

It is advantageous to incorporate a fatty alcohol, i.e., an aliphatic monohydric alcohol having from 18 to 24 carbon atoms into the grease composition. Suitable fatty alcohols can be obtained from natural oils. Biodegradable higher alcohols which are obtained by the process developed by K. Ziegler (DT-PS 1,014,088) and remain as a distillation residue after distilling off the alcohol faction(s) containing at least 18 carbon atoms are suitable. An addition of such a fatty alcohol to the grease improves the emulsifying power of the vegetable-derived gel, produces an improved fulling resistance (measured according to DIN 51 804) in the lubricant obtained, and also acts as a consistency regulator. The grease composition remains effective even after some of the water content of the lubricant evaporates after the lubricant is applied.

In addition, the lubricant according to the invention is improved by the presence of a conventional emulsifying agent, which is likewise biodegradable and enhances the stability of the emulsion. Since the aqueous vegetable-derived gel already has an emulsifying action and this is increased if necessary by adding a fatty alcohol, the amount of emulsifying agent can be kept relatively low.

Graphite, molybdenum disulphide or other conventional solid lubricity additive can be added to the grease composition preferably suspended in finely divided or colloidal form.

Solid lubricity additives of this type substantially increase the extreme pressure properties of the lubricant film. Their effect of reducing wear can be further improved by adding an alkali metal borate, in particular, sodium tetraborate (borax). As a result of the consistency of the lubricants according to the invention considerable amounts of such solids can be incorporated into the thickened emulsions while retaining the stability of the grease.

Furthermore, it is advantageous to add a glycerol to the grease composition according to the invention to improve its low-temperature characteristics and to act as an additional consistency regulator. Effective polyhydric aliphatic alcohols include trimethylolpropane and mannitol.

In the grease according to the invention, the amounts of the above specified components are not particularly critical and may be altered within relative wide ranges so that the required consistency and lubricating effect for each particular application can be achieved.

For applications which do not demand high requirements as regards lubricating action, load capacity and frost resistance, the lubricant according to the invention may consist of 0.2 – 10% by weight of gel-forming polysaccharide
1 – 50% by weight of natural oil and/or fat
0 – 50% by weight of fatty alcohol with at least 18 carbon atoms, and
10 – 95% by weight of water.

The higher the amount of vegetable-derived thickener, the greater is the consistency obtained. Greases of this type are illustrated in the following Table 1.

For applications demanding more stringent requirements, the grease according to the invention should also contain, in addition to the above components;

10 – 50% by weight of glycerol or a similar trihydric aliphatic alcohol
0.25 – 30% by weight of finely divided graphite or molybdenum disulphide
0 – 6% by weight of sodium tetraborate, and
0.05 – 5% by weight of emulsifying agent.

Compositions of this type are illustrated in the following Table 2.

In a preferred composition, the lubricant according to the invention consists of:

0.5 – 5% by weight of alginate or cellulose derived thickening agent
2 – 10% by weight of natural oil and/or fat
10 – 30% by weight of fatty alcohol (with at least 18 carbon atoms)
20 – 30% by weight of glycerol or trihydric alcohol
0.25 – 15% by weight of graphite or molybdenum disulfide
2 – 5% by weight of sodium tetraborate
0.5 – 3% by weight of emulsifying agent, and
20 – 60% by weight of water.

The lubricants in accordance with the invention may conveniently be prepared from the aforementioned components by homogeneously distributing and steeping the vegetable-derived thickening agent in water at room temperature using a high speed stirrer. After swelling has taken place, which takes about 1 hour in the case of alginates, the remaining components are added with continuously slow stirring which procedure is best performed in a heated container equipped with a planetary paddle mixer. When using higher molecular weight alcohols, which can have melting points of 50° – 65° C, or natural fats, the grease mixture must be heated until all of the components have liquefied. The order in which the individual components are added, however, is not critical.

The alginates used as thickening agents in the lubricants in accordance with the invention are the known water-soluble salts of alginic acid obtained from algae, alginic acid being sparingly soluble in water. Such salts include the ammonium and alkali metal salts, sodium alginate, potassium alginate and the ammonium alginates formed from alginic acid and the lower molecular weight $C_1$ to $C_5$ amines are commercially available and are used as gel-forming, film-forming and thickening agents.

Derivatives of natural cellulose, such as methyl- or ethyl-ether cellulose or carboxy-methyl-cellulose and salts are also known and commercially available for similar purposes. Relatively low concentrations of the cellulose derivatives form stable, highly viscous, aqueous solutions and often have a good emulsifying and dispersion power. Also, they are not very sensitive to the addition of water-soluble alcohols; furthermore; like the alginates, they are completely unaffected by the degree of water hardness. Alginates as well as cellulose derivatives and mixtures of both are, therefore, suitable as thickening agents.

The lubricating agents according to the invention are illustrated by the following animal or vegetable fats and oils: beef tallow, lard, neat's-foot oil, rapeseed oil, olive oil, coconut oil, palm-kernel oil or castor oil and similar oils which are predominantly glycerides of saturated or unsaturated fatty acids with approximately 6 – 24 carbon atoms.

As solid lubricity additives, the lubricants according to the invention may contain graphite, especially graphite having an average crystallite size of about 40 microns, and/or similar finely divided or colloidal molybdenum disulphide. Their action of reducing wear is conveniently enhanced by adding an alkali metal borate, for example borax.

The lubricants according to the invention are improved by the addition of conventional emulsifying agents which, especially in the case of fairly large amounts of high molecular weight alcohols and animal or vegetable fats and oils, is able to confer on the components — depending on the amount of water — the characteristics of a water-in-oil or oil-in-water emulsion. Suitable emulsifiers are the fatty acid soaps such as sodium and potassium oleate and stearate, fatty acid esters such as sorbitol monooleate or glycerol monostearate and the like, and also wool fat alcohols.

Examples of the composition and properties of lubricants in accordance with the invention are given in the following Tables 1 and 2:

Table 1 gives six basic formulations, Nos. 1–6. They contain the component combinations essential according to the invention. Comparison Example 7 gives a calcium soap lubricating grease corresponding to the German Federal Railways Specification 007.02.

The lubricant of Example 1 contains only rapeseed oil and is free of solid lubricants, which are usually used or added for increasing the load carrying capacity of greases and the like. The load capacity of 500 pk, measured by the Almen-Wieland method (AW) is correspondingly low. However, in comparison with the mineral-oil containing calcium soap grease (comparison Example 7) the fat is clearly better.

By adding 10% by weight or graphite (Example 2) there is a very marked improvement in the pressure of load carrying capacity compared with Example 1. The same is true when sodium tetraborate (Examples 3 and 4) is added, and the addition of molybdenum disulphide has been found to be outstandingly effective, as can be seen from Examples 5 and 6. On adding 1.5% of $MoS_2$ (Example 6) the result (as regards the AW test) of Example 2 with an addition of 10% of graphite is greatly exceeded.

The Examples 8 to 16 of Table 2 are formulations which in addition to other thickening agents contain amounts of higher molecular weight alcohols and glycerol.

Formulations can be regarded as having optimum properties if their pressure absorption or load carrying capacity, as measured by the Almen-Wieland test, is about 2000 Kp or above.

The addition of molybdenum disulphide has proved to be especially advantageous, and a load-bearing capacity of 2200 Kp for the lubricating film can be achieved with an amount of only 0.5% (Example 16).

TABLE 1

| | | Examples | | | | | | |
|---|---|---|---|---|---|---|---|---|
| | | 1 | 2 | 3 | 4 | 5 | 6 | 7 |
| Alginate* | % by wt. | 2 | 2 | 2 | 2 | 2 | 2 | ° |
| Water | " | 95 | 85 | 92 | 90 | 92 | 93.5 | |
| Rapeseed oil | " | 2 | 2 | 2 | 2 | 2 | 2 | |
| Emulsifier** | " | 1 | 1 | 1 | 1 | 1 | 1 | |
| Graphite*** | " | | 10 | | | | | |

TABLE 1-continued

| | | Examples | | | | | | |
|---|---|---|---|---|---|---|---|---|
| | | 1 | 2 | 3 | 4 | 5 | 6 | 7 |
| Molybdenum disulphide**** | " | | | | | 3 | 1.5 | |
| Sodium tetraborate | | | | 3 | 5 | | | |
| Consistency according to DIN 57 804: | | | | | | | | |
| Rest penetration | | 420 | 413 | 433 | 418 | 421 | 420 | 430 |
| Fulling penetration | | 445 | 441 | 450 | 443 | 435 | 435 | 450 |
| Almen-Wieland test, Kp | | 500 | 1500 | 1250 | 1650 | >2500 | 2000 | 250 |

*ammonium alginate
**polyoxyethylene sorbitol monooleate
***synthetic, average grain size : <30 μm
****average grain size : <0.3 μm
° mineral oil-containing calcium soap grease (according to specification 077.02 of the German Federal Railways)

TABLE 2

| | Examples | | | | | | | | |
|---|---|---|---|---|---|---|---|---|---|
| | 8 | 9 | 10 | 11 | 12 | 13 | 14 | 15 | 16 |
| Alginate | | | 1.5* | 1.5* | 1.5* | 1.5* | 1.5* | 5** | 1.5** |
| Methylcellulose | 1.0 | 1.0 | | | | | | | |
| Water | 67.5 | 67.5 | 55.5 | 36.5 | 26.5 | 45.0 | 55.0 | 10 | 65 |
| Alcohols ($>C_{18}$) | | | | | | 10.0 | 30.0 | 50 | |
| Glycerol | 20.0 | 20.0 | 30.0 | 30.0 | 30.0 | 30.0 | | | 30 |
| Rapeseed oil | 10.0 | | 2.0 | | | 2.0 | 2.5 | 25 | 2.0 |
| Beef Tallow | | 10.0 | | 30.0 | 30.0 | | | | |
| Emulsifier | 1.5° | 1.5° | 1.0 | 2.0° | 2.0°° | 1.5 | 1.0 | | 1.0 |
| Graphite | | | 10.0 | | 10.0 | 10.0 | 10.0 | 10 | |
| Molybdenum disulphide | | | | | | | | | 0.5 |
| Consistency according to DIN 51 804 : | | | | | | | | | |
| Rest penetration | 402 | 360 | 358 | 295 | 293 | 407 | 384 | 271 | 433 |
| Fulling penetration | 423 | 391 | 403 | 333 | 338 | 391 | 386 | 282 | 458 |
| Almen-Wieland Test, Kp | 1900 | 1800 | 1600 | 2500 | 2500 | 2200 | 2100 | 2500 | 2200 |

*Sodium alginate
**Ammonium alginate
° potassium oleate
°° sorbitol monooleate

What is claimed is:

1. A grease composition comprising from 10 to 95 weight percent water, from 0.2 to 10 weight percent of a water-soluble, vegetable-derived thickening agent selected from the group consisting of ammonium and alkali metal salts of alginic acid and the methyl-, ehtyl- and carboxymethyl derivatives of cellulose, from about 1 to 50 weight percent of an animal or vegetable fat, oil or corresponding glyceride and from about 0.05 to 5 weight percent of an emulsifying agent selected from the group consisting of sodium and potassium oleate and stearate, sorbitol monooleate, glycerol monostearate and polyioxyethylene sorbitol monooleate.

2. A grease composition according to claim 1 containing from about 0 to 50 weight percent of a fatty alcohol having from 18 to 24 carbon atoms.

3. A grease composition according to claim 1 in which said animal or vegetable fat or oil is selected from the group consisting of beef tallow, lard, neat's-foot oil, rapeseed oil, olive oil, coconut oil, palm-kernel oil, castor oil, and the corresponding glycerides of aliphatic monocarboxylic acids having from 6 to 24 carbon atoms.

4. A grease composition according to claim 1 in which said thickening agent is ammonium alginate.

5. A grease composition according to claim 1 in which said thickening agent is sodium alginate.

6. A grease composition according to claim 1 in which said thickening agent is methyl cellulose.

7. A grease composition according to claim 1 in which said thickening agent is potassium alginate.

8. A grease composition according to claim 1 in which said thickening agent is carboxymethyl cellulose.

9. A grease composition according to claim 1 containing from 10 to 50 weight percent of a trihydric aliphatic alcohol having from 3 to 10 carbon atoms and from 0.25 to 30 weight percent of graphite or molybdenum disulfide.

10. A grease composition according to claim 7 containing from 0 to 6% sodium tetraborate.

11. A grease composition according to the claim 1 containing from about 20 to 60 weight percent water, from about 0.15 to 5 weight percent of said vegetable-derived thickening agent and from about 2 to 10 weight percent of an animal or vegetable fat, oil or corresponding glyceride.

12. A grease composition according to claim 11 containing from 10 to 30 weight percent of an aliphatic monohydric alcohol containing from 18 to 24 carbon atoms.

13. A grease composition according to claim 12 containing from 20 to 30 weight percent of a trihydric alcohol having from 2 to 10 carbon atoms and 0.5 to 15 weight percent of graphite or molybdenum disulfide.

14. A grease composition according to claim 13 containing from 2 to 5 weight percent of sodium tetraborate and from 0.5 to 3 weight percent of an emulsifying agent.

* * * * *